US009903657B2

(12) United States Patent
Fruehling

(10) Patent No.: US 9,903,657 B2
(45) Date of Patent: Feb. 27, 2018

(54) DEVICE FOR TREATING, IN PARTICULAR COOLING, BULK MATERIAL USING A GAS

(71) Applicant: Claudius Peters Projects GmbH, Buxtehude (DE)

(72) Inventor: Reiner Fruehling, Hamburg (DE)

(73) Assignee: Claudius Peters Projects GmbH, Buxtehude (DE)

( * ) Notice: Subject to any disclaimer, the term of this patent is extended or adjusted under 35 U.S.C. 154(b) by 81 days.

(21) Appl. No.: 15/212,881

(22) Filed: Jul. 18, 2016

(65) Prior Publication Data

US 2017/0016674 A1 Jan. 19, 2017

(30) Foreign Application Priority Data

Jul. 17, 2015 (EP) ..... 15177296

(51) Int. Cl.

| | |
|---|---|
| ***F23H 7/08*** | (2006.01) |
| ***F27D 15/02*** | (2006.01) |
| ***F27D 17/00*** | (2006.01) |
| *F27D 3/00* | (2006.01) |

(52) U.S. Cl.

CPC ..... *F27D 15/022* (2013.01); *F27D 15/0213* (2013.01); *F27D 17/004* (2013.01); *F27D 2003/0092* (2013.01); *F27D 2015/024* (2013.01); *F27D 2015/0226* (2013.01); *F27D 2015/0233* (2013.01); *F27D 2015/0246* (2013.01)

(58) Field of Classification Search

CPC ... F23H 7/08; F23K 3/10; F27D 15/02; F27D 15/0213

See application file for complete search history.

(56) References Cited

U.S. PATENT DOCUMENTS

| | | | | |
|---|---|---|---|---|
| 2,240,590 | A | 5/1941 | Wallace | |
| 4,870,913 | A | 10/1989 | Schneider | |
| 6,345,580 | B1 | 2/2002 | Klintworth | |
| 6,796,141 | B2 * | 9/2004 | Kastingschafer | F27D 15/0213 62/378 |
| 7,114,612 | B2 * | 10/2006 | Meyer | B65G 25/065 198/750.2 |
| 7,798,809 | B2 * | 9/2010 | Mersmann | C04B 7/47 110/281 |

(Continued)

FOREIGN PATENT DOCUMENTS

| | | |
|---|---|---|
| DE | 3734043 | 4/1989 |
| DE | 19651741 | 6/1998 |

(Continued)

*Primary Examiner* — Gregory A Wilson

(74) *Attorney, Agent, or Firm* — Morrison & Foerster LLP

(57) ABSTRACT

A device for treating bulk material with a gas, the device including a grate through which gas can flow from an under-grate space to the upper side and which conveys a layer of bulk material in a conveying direction from a loading end to a discharge end. The grate has a plurality of mutually adjacent rows, each of which includes at least one bar that is elongate in the conveying direction and may be moved alternately back and forth in the conveying direction. Driving is controlled such that the forward stroke of the at least one bar of two adjacent rows takes place at the same time, while the rearward stroke of the at least one bar of two adjacent rows takes place at different times.

11 Claims, 5 Drawing Sheets

(56) References Cited

U.S. PATENT DOCUMENTS

| | | | | |
|---|---|---|---|---|
| 7,886,457 | B2 * | 2/2011 | Dikty | F26B 17/26 110/268 |
| 9,371,996 | B2 * | 6/2016 | Schmid | F23H 7/08 |
| 9,605,902 | B2 * | 3/2017 | von Wedel | F27D 15/022 |
| 2008/0156238 | A1 * | 7/2008 | Ma | F23H 7/14 110/281 |
| 2014/0341742 | A1 | 11/2014 | Knoop et al. | |

FOREIGN PATENT DOCUMENTS

| | | |
|---|---|---|
| DE | 202006011213 | 12/2007 |
| DK | 199901403 | 4/2001 |
| EP | 1099923 | 5/2001 |

* cited by examiner

A-A

DEVICE FOR TREATING, IN PARTICULAR COOLING, BULK MATERIAL USING A GAS

CROSS-REFERENCE TO RELATED APPLICATIONS

This application claims the benefit of EP Application No. 15177296.9, filed on Jul. 17, 2015, the entire contents of which is incorporated herein by reference.

FIELD OF THE INVENTION

The invention relates to a device for treating, in particular cooling, bulk material using a gas.

BACKGROUND OF THE INVENTION

In order to treat bulk material using a gas, it is known to convey a bed of bulk material continuously over a grate. During this, the gas passes through the grate and then flows through the bed of bulk material. This type of treatment of bulk material using gas is frequently found for example when cooling cement clinker using air.

For conveying the bulk material over the grate, so-called reciprocating grates are known, which comprise overlapping rows of grate plates that are alternately unmoving in the conveying direction and moved back and forth in the conveying direction. A cooler of this type is described in DE-A-37 34 043.

Also known in the prior art are so-called moving floor coolers, in which the grate comprises a plurality of bars that are elongate in the conveying direction and are moved forward in the conveying direction at the same time and then back again at different times. During this, the bars move on rollers that are arranged on a steel substructure. It is also possible to provide on the steel substructure—and hence below the grate—air baffles or air chambers, by means of which flow through the grate and through the bulk material lying thereon can be made to differ over the width and/or length of the cooler. Examples of coolers of this type can be found inter alia in DK-A-1999/1403, U.S. Pat. No. 2,240,590 or DE-A-196 51 741.

In both the above-mentioned types of cooler construction, there is always provided a housing by means of which the space above the grate is separated from the surrounding area. As a result, the gas flowing through the bed of bulk material may be collected and supplied to a further use. In the case of a cooler for hot cement clinker, the correspondingly collected, heated cooling air may be used for example for the upstream kiln, for pre-heating the raw material and/or for power generation.

The upper parts of bulk material coolers, which delimit the space above the grate, typically comprise a steel casing, against the inner side of which masonry or another fire-resistant layer is constructed. A corresponding protective layer is required to protect the steel casing from wear.

In the case of a complete new construction of a cooler, the upper part may be erected such that the dimensions correspond to the grate and the substructure below it. Since a corresponding complete new construction of a cooler is costly, the possibility is frequently considered of obtaining parts—in particular the upper part—of an old, already existing bulk material cooler and of equipping it with a new grate and where appropriate a new grate substructure. Because of the improved wear properties, in this case reciprocating grate coolers are frequently to be converted into moving floor coolers.

Because of the prerequisites of manufacturing technology, and in order to avoid costly customized manufacture, however, the bars of a moving floor cooler typically have standardized (at least the manufacturer's own) dimensions, in particular a standardized width. The steel substructure is also adjusted to this standardized bar width, as a result of which a low-cost modular substructure system is made possible.

If an existing bulk material cooler upper part is to be equipped with a new moving floor cooler, the problem frequently occurs that the internal width of the upper part does not correspond to a whole number of multiples of the standard width of bars. To solve this problem, according to the prior art a moving floor cooler having a bar width that is adjusted to the existing upper part can be manufactured, although this means a costly customized manufacture. As an alternative, it is known to reduce the internal width of the upper part by constructing additional masonry or another fire-resistant layer such that this dimension corresponds to a multiple of a standard width for bars. However, a solution of this type is complex and moreover results in a grate surface area of the new moving floor cooler that is smaller than the original reciprocating grate cooler.

SUMMARY OF THE INVENTION

An object of the invention is to provide a device for treating, in particular cooling, bulk material using a gas in which the disadvantages known from the prior art—in particular in connection with converting a reciprocating grate cooler into a moving floor cooler—no longer occur, or occur only to a reduced extent.

Accordingly, embodiments of the invention relate to a device for treating, in particular cooling, bulk material using a gas, which has a grate through which gas can flow from an under-grate space to the upper side and which conveys a layer of the bulk material in a conveying direction, from a loading end to a discharge end, wherein the grate has a plurality of mutually adjacent rows of in each case at least one bar that is elongate in the conveying direction and may be moved alternately back and forth in the conveying direction and whereof driving is controlled such that the forward stroke of the in each case at least one bar of two adjacent rows takes place at the same time, while the rearward stroke of the in each case at least one bar of two adjacent rows takes place at different times, wherein, for increasing the grate width, the grate includes in the conveying direction on at least one side in each case a row of at least one unmoving adapter, wherein gas can flow through the at least one adapter from the under-grate space to the upper side.

As a result of the row, provided according to the invention, of at least one adapter on one or—preferably—on both sides of the grate, the grate can also have a width that does not correspond to a multiple of the width of the rows of bars. Consequently, any already existing bulk material cooler upper parts may be equipped with a moving floor cooler without this necessitating a customized manufacture of bars or structural measures in order to alter the internal width of a bulk material cooler upper part. Since the at least one adapter that is provided according to the invention is moreover unmoving—so, unlike the bars, is not moved back and forth—it is also possible to make use of a standardized grate substructure that is adjusted to bars of standardized width. Here too, costly customized manufacture may thus be avoided. In the context of the invention, the expression "standardized" should be understood in broad terms. Thus, the expression is not restricted to standards drawn up by national or international organizations but also includes for example the manufacturer's own and thus where appropriate manufacturer-specific standard dimensions of components, and so on.

According to the invention, the adapter provided is gas-permeable from the underside to its upper side and so gas—for example cooling air—can flow through it from the under-grate space. The upper side of the adapter may for this purpose—where appropriate in a manner similar to the upper side of the bars—be provided with a plurality of gas passage openings. The expression "under-grate space" indicates the region below the grate, that is to say below the bars and the at least one adapter.

Because, according to the invention, a through-flow of gas is made possible in the region of the at least one adapter in a manner comparable to that of the bars of the grate, the gas can effectively flow through—and thus for example cool—bulk material that lies on the at least one adapter. By comparison with a moving floor cooler without any adapters—for which for example the internal dimension of a bulk material cooler upper part has been made smaller—the effective grate cooler surface area is thus larger.

During operation of the device according to the invention, there is moreover formed, in the bulk material layer above the at least one adapter that bears against the unmoving wall laterally delimiting the grate, a wedge-shaped region in which the bulk material remains virtually unmoving. This wedge-shaped region thus provides an intrinsic protection against wear for the wall, since direct contact between the wall and the moving bulk material is avoided.

Typically, a row of adapters includes a plurality of adapters arranged one after the other in the conveying direction, wherein the individual adapters may be of the same construction. The same applies to rows of bars, in which a plurality of bars that are arranged one after the other in the conveying direction and are preferably of the same construction may be provided. The bars of different rows of bars are likewise preferably of the same construction as one another. This allows the number of different structural elements for a device according to the invention to be markedly reduced, which simplifies and is favourable for manufacture.

In order to keep the proportion of bulk material that lies on the at least one adapter and may remain unmoving in the device according to the invention as low as possible, it is preferable for a row comprising at least one adapter to be less wide than any row comprising at least one bar. In particular, the width of a row comprising at least one adapter may be less than 70%, preferably less than 50%, further preferably less than 30% of the width of a row comprising at least one bar. The at least one adapter that is provided according to the invention is thus narrower than a bar.

The at least one adapter may be the result of a customized manufacture that is made for a particular, already existing bulk material cooler upper part. Since it is possible otherwise to make use of standardized bars and a standardized substructure adjusted thereto in the device according to the invention, however, a device according to the invention is still lower-cost than a moving floor cooler which as a whole is the result of customized manufacture (for example because it has a special bar width).

It is furthermore preferable if the device has a superstructure that reaches over the grate in a direction transverse to the conveying direction, and the at least one adapter is fixedly secured to the superstructure. The superstructure may be in particular a where appropriate already existing bulk material cooler upper part. The superstructure also typically forms the walls that laterally delimit the grate. Because the at least one adapter is directly secured to the superstructure, the adapter is arranged unmoving without the need for additional securing devices. In particular, there is thus no need for the grate substructure that is provided for the bars to be constructed to receive and secure adapters. Rather, it is possible to make use of a standard, for example a modular, grate substructure, since the at least one adapter that is additionally provided according to the invention can be secured separately therefrom.

Between the row of at least one unmoving adapter and the row of bars adjacent thereto, a sealing device is preferably provided. By means of a sealing device of this type, it is possible to avoid bulk material passing through the gap required for relative movement between the adapter and the adjacent bar and into the under-grate space.

It is particularly preferable if the sealing device includes, on the side of at least one adapter adjacent to the bar, a longitudinal gutter that is set back from the upper side of the adapter and with which an elongate strip of the adjacent bar engages. The desired sealing can be achieved as a result of a comparatively simple and thus fail-safe construction of this kind. The strip on the above-described bar may preferably take the form of an angled strip, wherein one limb of the angled strip may then form at least one part of the upper side of the bar on which the bulk material lies. Because the part of the sealing device that comes into direct contact with the bulk material layer is arranged on the bar and is thus moved therewith, a corresponding sealing device does not in practice enlarge the unmoving region at the edge of the grate beyond the upper side of the at least one adapter.

The sealing device may preferably be ventilated. This means that gas from the under-grate space may flow through the sealing device to the upper side of the grate. As a result of a gas flow of this type, the penetration of bulk material into the sealing device and the possibility of a residue of material falling through the grate can be reduced.

It is preferable if the upper side of the at least one adapter has at least one recess that holds material. In the event of the bulk material cooling, material that has already cooled can accumulate in a recess of this type and thus prevent direct contact between the adapter and bulk material that is still hot. In other words, an intrinsic protection against wear can be achieved for the at least one adapter.

BRIEF DESCRIPTION OF THE DRAWINGS

The invention will now be described by way of example using advantageous embodiments, with reference to the attached drawings, in which.

DETAILED DESCRIPTION OF THE INVENTION

Figure 1:
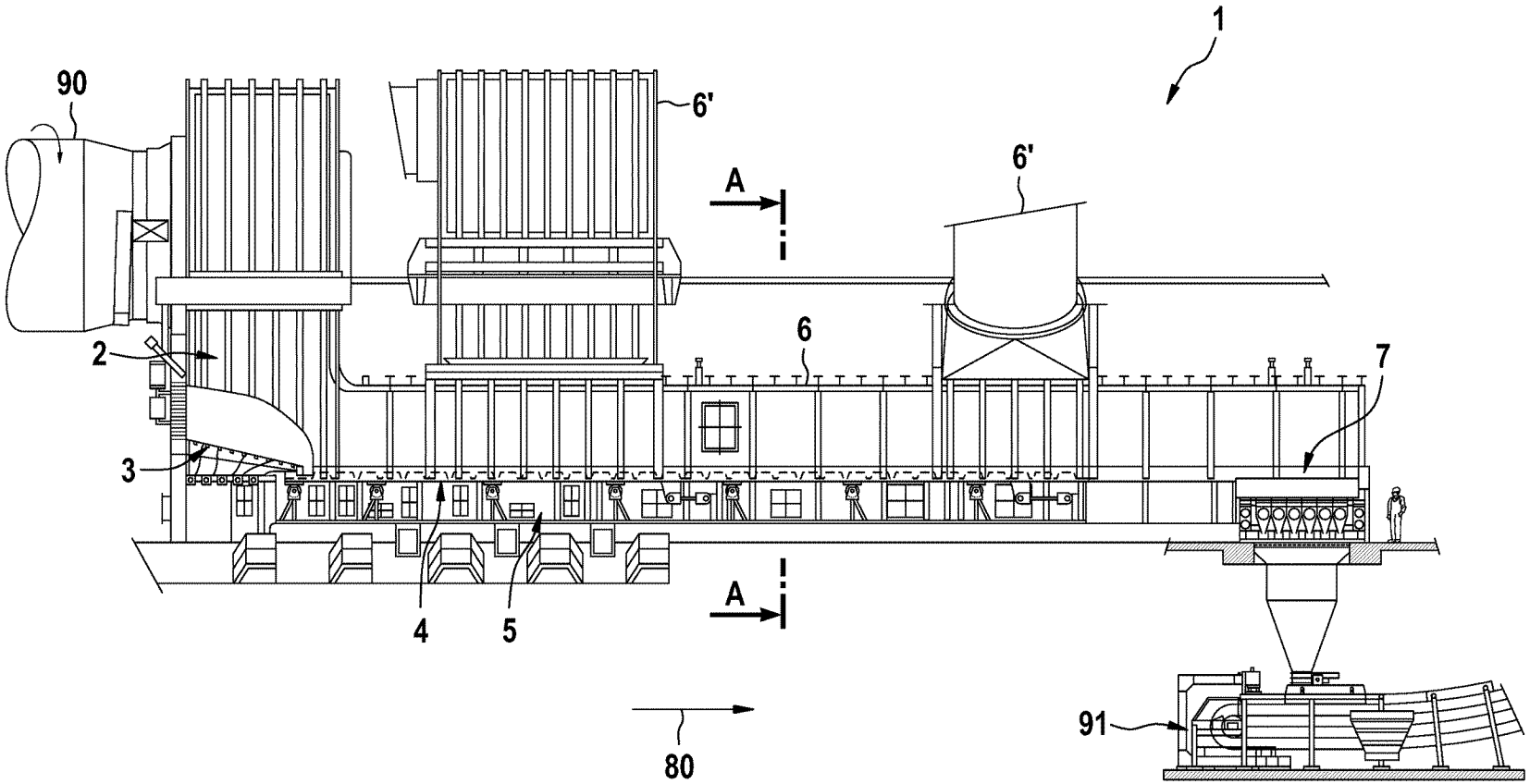
FIG. 1 shows a schematic side view of a device according to the invention for treating bulk material using gas.
Figure 3:
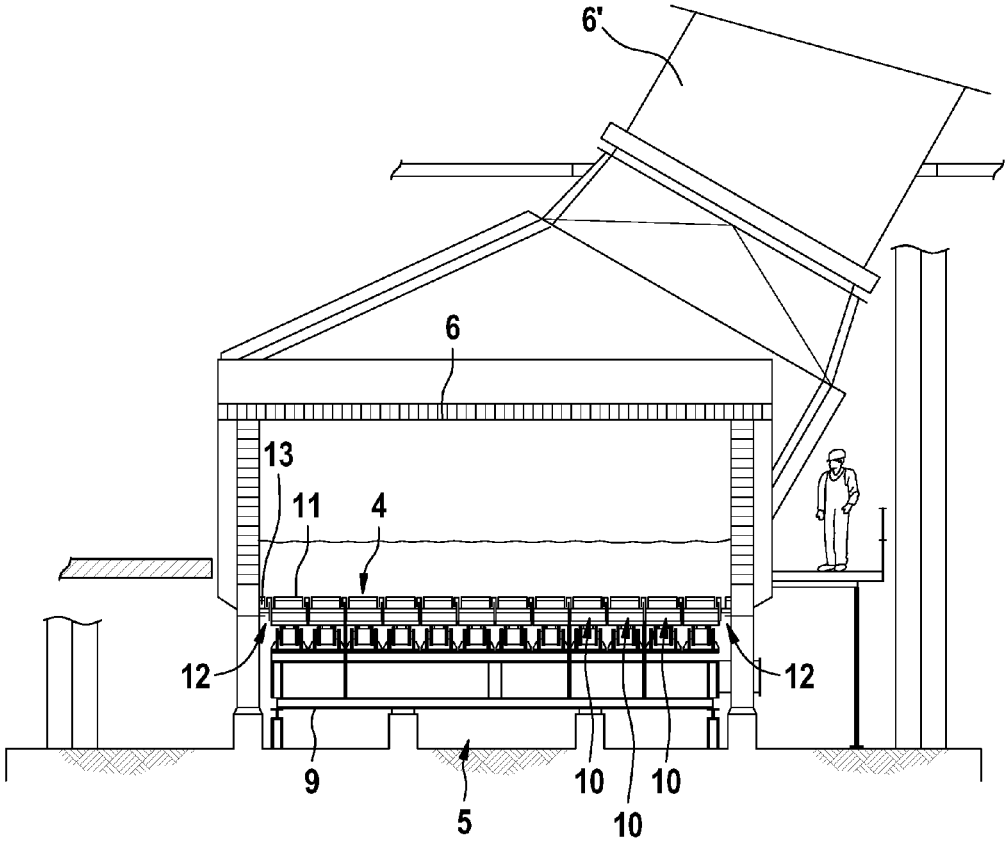
FIG. 3 shows a section through the device according to FIG. 1.

FIG. 1 illustrates an exemplary embodiment of a device 1 according to the invention for treating bulk material using gas. This device 1 is a bulk material cooler, in which hot cement clinker coming from a kiln 90 is cooled using cooling air. FIG. 3 shows the section A-A from FIG. 1.

The cement clinker or bulk material coming from the kiln 90 falls through a loading shaft 2, first onto a loading section 3 of the device 1, and because of the inclined arrangement of the loading section 3 from there onto a grate 4. The grate 4 is ventilated from the under-grate space 5, that is to say that cooling air flows from the under-grate space 5 through the grate 4 and bulk material lying thereon before it is guided away—having been heated by the hot bulk material—through air outlets 6' arranged in the superstructure 6 of the device 1, and where appropriate is fed to a further use (power generation, for pre-heating, etc.). As can be seen in FIG. 3, the superstructure 6 reaches over the grate 4 in a direction transverse to the conveying direction 80.

The bulk material to be cooled is conveyed through the grate 4 in the conveying direction (indicated by the arrow 80) from the loading section 3 to the discharge end 7 of the device and from there is transported away by way of conveyor belts 91. As explained in more detail below with reference to FIG. 2, the grate 4 for this purpose takes the form of a moving floor.

Figure 2:
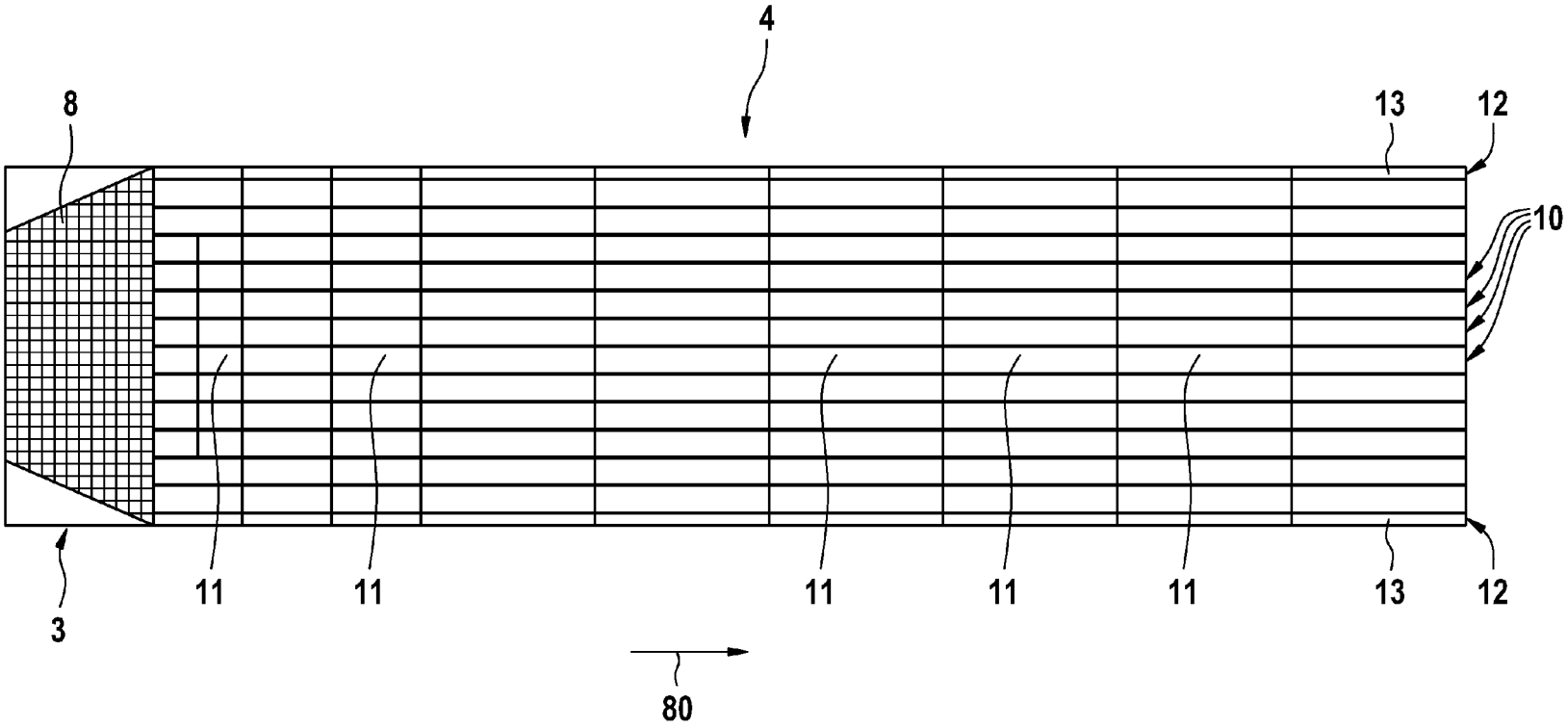
FIG. 2 shows a schematic plan view of the grate of the device from FIG. 1.

FIG. 2 shows a schematic and simplified plan view of the loading section 3 and the grate 4 of the device 1 from FIG. 1. The loading section 3 includes a plurality of static tiles 8 over which the bulk material falling thereon slides towards the grate 4. The grate 4 includes a plurality of mutually adjacent rows 10 which each include a plurality of elongate bars 11 arranged one after the other in the conveying direction. Gas can flow through the bars 11. In other words, the bars 11 are formed such that cooling air can flow from the under-grate space 5 through the bars 11 and into the bulk material lying on the bars 11. For this purpose, the bars 11 have gas passage openings on their upper side, which bears the bulk material, although these are not illustrated in FIG. 2 for reasons of clarity. Provided in the under-grate space 5 is a substructure 9 on which the rows 10 of bars 11 are mounted. The under-grate space 5 may be divided into chambers in the longitudinal direction (that is to say parallel to the conveying direction 80) and/or in the transverse direction, in order to provide different ventilation zones over the length and/or width.

The rows 10 of bars 11 may each be moved back and forth in the conveying direction 80, wherein the bars 11 of a row 10 are connected to one another such that they are moved together. Driving (not illustrated) of the rows 10 of bars 11 is controlled such that the forward stroke of the bars 11 of two adjacent rows 10 takes place at the same time, while the rearward stroke of the bars 11 of two adjacent rows 10 takes place at different times. As a result of this movement scheme, conveying of the bulk material in the conveying direction 80 is achieved by the moving floor principle. As can be seen directly in the scheme according to FIG. 2, the grate 4 includes only bars 11 in three different dimensions, although the width of all the bars 11 in a direction transverse to the conveying direction 80 is identical. By using correspondingly standardized bars 11, the corresponding region of the grate 4 can be manufactured at low cost, another reason for this being the possibility of making use of a standardized substructure 9 and drive.

On each of the two sides of the rows 10 of bars 11 there is provided a row 12 of adapters 13, the width of the adapters 13 in a direction transverse to the conveying direction 80 being less than half the width of the bars 11. The adapters 13 are unmoving and so, unlike the bars 11, in particular cannot be moved back and forth in the conveying direction. Gas may flow from the under-grate space 5 to the upper side through the adapters 13, however, similarly to the bars 11. For this purpose, the adapters 13 may have gas passage openings on their upper side, but for reasons of clarity these are not illustrated in FIG. 2.

Figure 4:
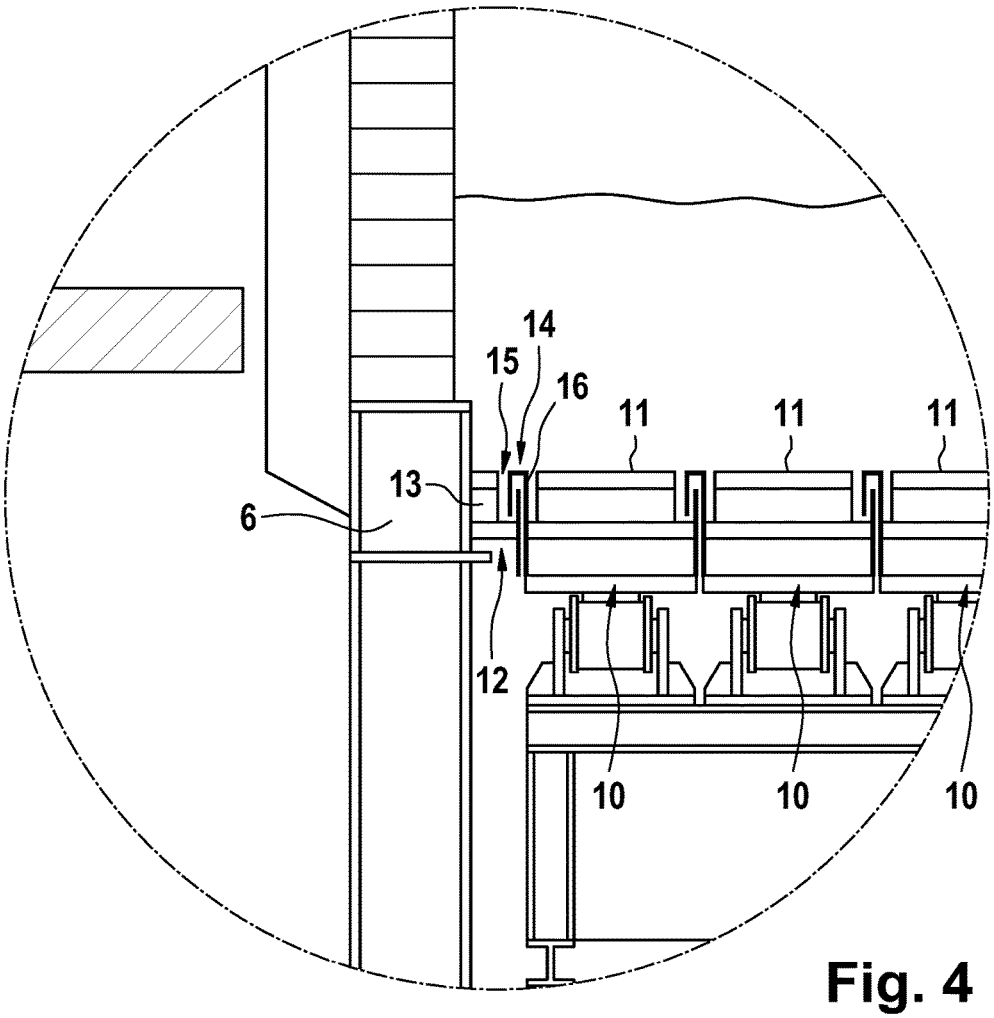
FIG. 4 shows a detail of FIG. 3, on a larger scale.

FIG. 4 illustrates the region around a row 12 of adapters 13 from FIG. 3 in detail. As can be seen in FIG. 4, the adapter 13 of the row 12—as indeed all the other adapters of this row 12—is fixedly secured to the superstructure 6. As a result, the adapters 13 are on the one hand secured to be unmoving, and on the other hand there is no need to adjust the substructure 9 for the purpose of securing adapters 13 thereto, so use may be made of a standardized substructure 9.

Provided between the row 12 of adapters 13 and the row 10 of bars 11 adjacent thereto is a sealing device 14. The sealing device 14 includes, on the side of the adapter 13 adjacent to the bar 11, a longitudinal gutter 15 that is set back from the upper side of the adapter 13 and with which a likewise elongate angled strip 16 of the adjacent bar 11 engages (cf. also FIG. 5). It is possible for air to flow through the labyrinthine gap that is thus produced from the under-grate space 5, for the purpose of ventilating the sealing device 14, as a result of which the possibility that bulk material will penetrate into the sealing device 14 can be reduced.

Figure 5:
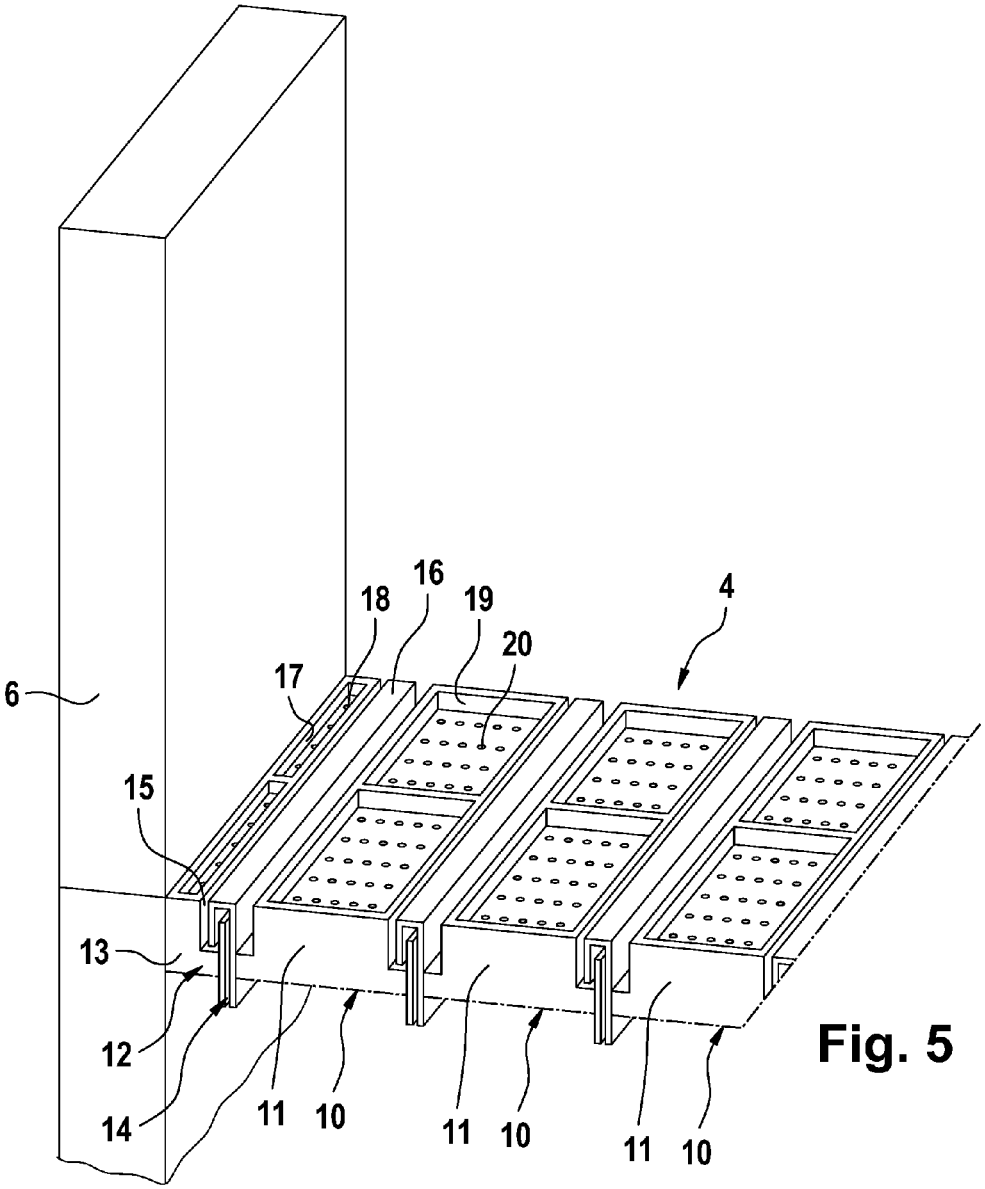
FIG. 5 shows a schematic three-dimensional illustration of the detail from FIG. 4.

FIG. 5 schematically illustrates, in a three-dimensional view, a section of the grate 4 in the region of an adapter 13 of the row 12. As illustrated, the adapter 13 has two recesses 17 in which bulk material can be held in order in this way to obtain an intrinsic protection against wear. The already mentioned gas passage openings 18 are arranged in the base of the recesses.

It can likewise be seen in FIG. 5 that the bars 11 also have recesses 19 of this type, on the base whereof the gas passage openings 20 are arranged.

The invention claimed is:

1. A device for treating bulk material with a gas, the device comprising a grate through which gas can flow from an under-grate space to an upper side and which is configured to convey the bulk material in a conveying direction from a loading end to a discharge end, wherein the grate comprises a plurality of mutually adjacent rows, each row comprising at least one bar that is elongate in the conveying direction and is configured to be moved alternately back and forth in the conveying direction, wherein the grate is configured to be controlled such that the forward stroke of the at least one bar of two adjacent rows takes place at the same time and the rearward stroke of the at least one bar of two adjacent rows takes place at different times, wherein the grate includes, in the conveying direction on at least one side, a row of at least one unmoving adapter for increasing the grate width, and wherein gas can flow through the at least one adapter from the under-grate space to the upper side.

2. The device of claim 1, wherein the row of at least one unmoving adapter is less wide than a row comprising at least one bar.

3. The device of claim 2, wherein the width of the row of at least one adapter is less than 70% of the width of the row comprising at least one bar.

4. The device of claim 2, wherein the width of the row of at least one adapter is less than 50% of the width of the row comprising at least one bar.

5. The device of claim 2, wherein the width of the row of at least one adapter is less than 30% of the width of the row comprising at least one bar.

6. The device of claim 1, comprising a superstructure that reaches over the grate in a direction transverse to the conveying direction, wherein the at least one adapter is fixedly secured to the superstructure.

7. The device of claim 1, comprising a sealing device disposed between the row of at least one unmoving adapter and an adjacent row of bars.

8. The device of claim 7, wherein the sealing device includes, on a side of the at least one adapter adjacent to the bar, a longitudinal gutter that is set back from an upper side of the adapter and with which an elongate strip of the adjacent bar engages.

9. The device of claim 8, wherein the elongate strip is an angled strip.

10. The device of claim 7, wherein the sealing device is ventilated.

11. The device of claim 1, wherein an upper side of the at least one adapter comprises at least one recess that is configured to hold bulk material.

* * * * *